US011401122B2

(12) United States Patent
Hayashi et al.

(10) Patent No.: US 11,401,122 B2
(45) Date of Patent: Aug. 2, 2022

(54) PAPER SHEET PROCESSING DEVICE

(71) Applicant: LAUREL PRECISION MACHINES CO., LTD., Osaka (JP)

(72) Inventors: Shigenori Hayashi, Yokohama (JP); Motonori Shinagawa, Saitama (JP)

(73) Assignee: LAUREL PRECISION MACHINES CO., LTD., Osaka (JP)

( * ) Notice: Subject to any disclaimer, the term of this patent is extended or adjusted under 35 U.S.C. 154(b) by 58 days.

(21) Appl. No.: 16/963,344

(22) PCT Filed: Jan. 21, 2019

(86) PCT No.: PCT/JP2019/001613
§ 371 (c)(1),
(2) Date: Jul. 20, 2020

(87) PCT Pub. No.: WO2019/146537
PCT Pub. Date: Aug. 1, 2019

(65) Prior Publication Data

US 2021/0101766 A1 Apr. 8, 2021

(30) Foreign Application Priority Data

Jan. 26, 2018 (JP) ..... JP2018-011781

(51) Int. Cl.
*B65H 1/02* (2006.01)
*B65H 1/12* (2006.01)
(Continued)

(52) U.S. Cl.
CPC ..... *B65H 3/06* (2013.01); *G07D 11/50* (2019.01); *B65H 2404/10* (2013.01); *B65H 2701/1912* (2013.01)

(58) Field of Classification Search
CPC . B65H 1/025; B65H 1/02; B65H 1/12; B65H 1/14; B65H 3/06; B65H 2404/10; G07D 11/165; G07D 11/50
See application file for complete search history.

(56) References Cited

U.S. PATENT DOCUMENTS

2019/0358641 A1* 11/2019 Abe ..... B65H 3/0684

FOREIGN PATENT DOCUMENTS

GB 2543555 A * 4/2017 ..... B65H 3/54
JP 03-095034 4/1991
(Continued)

OTHER PUBLICATIONS

International Search Report for PCT/JP2019/001613 dated Mar. 26, 2019, 2 pages.
(Continued)

*Primary Examiner* — Luis A Gonzalez
(74) *Attorney, Agent, or Firm* — Nixon & Vanderhye P.C.

(57) ABSTRACT

A paper sheet processing device includes: an ejection roller for ejecting a paper sheet; and a bill press for pressing the paper sheet against the ejection roller, wherein the bill press has: a bill press main body that moves in a direction to approach and separate from the ejection roller; a pressing portion that is provided on the ejection roller side of the bill press main body and moves in a direction to approach and separate from the bill press main body; and an elastic portion provided between the pressing portion and the bill press main body.

6 Claims, 13 Drawing Sheets

(51) Int. Cl.
*B65H 3/06* (2006.01)
*G07D 11/50* (2019.01)

(56) References Cited

FOREIGN PATENT DOCUMENTS

| | | | | |
|---|---|---|---|---|
| JP | 6-68337 | A | | 3/1994 |
| JP | 63-180633 | | | 11/1998 |
| JP | 2010-108025 | | | 5/2010 |
| JP | 2017-027198 | | | 2/2017 |
| KR | 101310492 | B1 | * | 9/2013 |
| RU | 2 613 223 | C2 | | 3/2017 |
| WO | WO 2017/014107 | A1 | | 1/2017 |

OTHER PUBLICATIONS

Official Notification dated Jan. 18, 2021 in Russian Application No. 2020123920, with English translation, 12 pages.

* cited by examiner

PAPER SHEET PROCESSING DEVICE

TECHNICAL FIELD

The present invention relates to a paper sheet processing device.

This application is the U.S. national phase of International Application No. PCT/JP2019/001613, filed Jan. 21, 2019 which designated the U.S. and claims priority to Japanese Patent Application No. 2018-11781, filed Jan. 26, 2018, the entire contents of each of which are incorporated herein by reference.

BACKGROUND ART

A bill processing device has been known in which bills set in a money receiving unit are taken into the device, the bills identified by an identification unit are temporarily held in a temporary holding unit, and after various processes are completed, the bills are transferred from the temporary holding unit to a storage unit or the like. The bill processing device described in Patent Document 1 supports the lowermost bill among those input into a money receiving unit in an accumulated state with a mounting plate, and when the bills are taken in, the mounting plate moves upward while moving the uppermost bill to a position where it can be taken in.

In addition, unlike the above system, there has also been known a bill processing device that sequentially takes in bills in an accumulated state from the lowermost bill. Some of such devices are provided with a bill pressing mechanism that presses a bill from above when the bill is taken in. As such a bill pressing mechanism, the bill pressing mechanism described in Patent Document 2 includes a mounting plate for placing bills on and a pressing plate for pressing bills from above to the mounting plate side. In this bill pressing mechanism, the pressing plate is provided so as to be freely rotatable about an axis that can be oriented in substantially the same direction as the bill feed direction (take-in direction), and is also provided so as to be freely rotatable about an axis that is oriented in a direction substantially orthogonal to the bill feed direction. As a result, when a bill is taken into the device, the bill pressing mechanism presses the bill by operating the pressing plate, and the pressing plate freely rotates along a bill in an upper layer portion of accumulated bills. Therefore, in this bill pressing mechanism, it is possible to prevent the occurrence of damage to the constituent members, feeding failures such as skewing of bills, bill counting failures, and the like.

PRIOR ART DOCUMENTS

Patent Documents

[Patent Document 1] Japanese Unexamined Patent Application, First Publication No. 2017-27198

[Patent Document 2] Japanese Unexamined Patent Application, First Publication No. Hei 3-95034

SUMMARY OF THE INVENTION

Problems to be Solved by the Invention

In the bill processing device of Patent Document 1, when bills are taken into the device, if there is a partial difference in thickness in the accumulated bills, a part to be pressed and a part not to be pressed will be generated, so that the posture of the bills will be in a skewed state, which may cause a take-in failure (jamming) Further, in the bill processing device of Patent Document 2, when bills are taken into the device, if there is a partial difference in thickness in the accumulated bills, although the pressing plate can be tilted accordingly, the cost increases.

Therefore, an object of the present invention is to provide a paper sheet processing device capable of suppressing the occurrence of jamming of paper sheets while suppressing an increase in cost.

Means for Solving the Problems

In order to achieve the above object, a paper sheet processing device according to a first aspect of the present invention includes an ejection roller for ejecting a paper sheet, and a bill press for pressing the paper sheet against the aforementioned ejection roller, wherein the aforementioned bill press has a bill press main body that moves in a direction to approach and separate from the aforementioned ejection roller, a pressing portion that is provided on the aforementioned ejection roller side of the aforementioned bill press main body and moves in a direction to approach and separate from the aforementioned bill press main body, and an elastic portion provided between the aforementioned pressing portion and the aforementioned bill press main body.

According to the paper sheet processing device of the above first aspect, if the bill press main body is brought close to the ejection roller when pressing the accumulated paper sheets against the ejection roller with the bill press, the pressing portion provided on the ejection roller side of the bill press main body presses the accumulated paper sheets to the ejection roller side. At this time, even if there is a partial difference in thickness in the accumulated paper sheets, the elastic portion deforms accordingly to absorb the partial difference in thickness. As a result, the pressing portion satisfactorily abuts against the accumulated paper sheets and satisfactorily presses the accumulated paper sheets. Therefore, it is possible to suppress the occurrence of jamming. Moreover, since it is configured so that the pressing portion is movably provided in the bill press main body and the pressing portion is energized by the elastic portion, the structure can be simplified and the increase in cost can be suppressed.

In the paper sheet processing device according to a second aspect of the present invention, the aforementioned bill press main body includes, on the aforementioned ejection roller side, a surface portion and a step portion recessed on the opposite side of the aforementioned ejection roller from the aforementioned surface portion, and the aforementioned pressing portion and the aforementioned elastic portion are arranged in the aforementioned step portion.

According to the paper sheet processing device of the above second aspect, the accumulated paper sheets are pressed to the ejection roller side by the surface portion provided on the ejection roller side of the bill press main body and the pressing portion provided in the step portion recessed from this surface portion of the bill press main body. Therefore, for example, it is possible to suppress a partial difference in pressing force by pressing a thick portion of the accumulated paper sheets with the pressing portion and pressing a thin portion with the surface portion of the bill press main body. As a result, it is possible to further suppress the occurrence of jamming.

In the paper sheet processing device according to a third aspect of the present invention, the aforementioned pressing portion is flush with the aforementioned surface portion by the energizing force of the aforementioned elastic portion.

According to the paper sheet processing device of the above third aspect, since the pressing portion is flush with the surface portion by the energizing force of the elastic portion, it is possible to suppress a partial difference in the pressing force even when there is little partial difference in thickness in the accumulated paper sheets.

In the paper sheet processing device according to a fourth aspect of the present invention, the aforementioned bill press main body has, within the range of the aforementioned surface portion, a concave portion which is recessed from the aforementioned surface portion and into which the ejection roller enters.

According to the paper sheet processing device of the above fourth aspect, since the concave portion into which the ejection roller enters is provided within the range of the surface portion of the bill press main body whose position with respect to the ejection roller is stable, the paper sheets can be smoothly ejected by the concave portion and the ejection roller of the bill press main body.

In the paper sheet processing device according to a fifth aspect of the present invention, a pair of the aforementioned pressing portions separated from each other are provided in a direction in which a long side of the paper sheet extends (long side extending direction), and the aforementioned surface portion is arranged between the pair of the pressing portions.

According to the paper sheet processing device of the above fifth aspect, it is possible to press both sides in the long side extending direction of the paper sheets by the pair of pressing portions provided by being separated from each other in the long side extending direction of the paper sheets, and to press an intermediate portion in the long side extending direction of the paper sheets by the surface portion of the bill press main body therebetween. Therefore, in the case where a thick portion is likely to be formed in the accumulated paper sheets on the end portion side in the long side extending direction of the paper sheets, it is possible to effectively suppress the occurrence of jamming.

In the paper sheet processing device according to a sixth aspect of the present invention, the aforementioned elastic portion is a plate-like elastic member orthogonal to a moving direction of the aforementioned bill press main body, and the aforementioned pressing portion has a plate shape which is orthogonal to the moving direction of the aforementioned bill press main body and is arranged on the aforementioned ejection roller side of the aforementioned elastic portion.

According to the paper sheet processing device of the above sixth aspect, since the elastic portion is a plate-like elastic member orthogonal to the moving direction of the bill press main body, and the pressing portion has a plate shape which is orthogonal to the moving direction of the bill press main body and is arranged on the ejection roller side of the elastic portion, the structure becomes simpler and the cost increase can be further suppressed.

In the paper sheet processing device according to a seventh aspect of the present invention, the aforementioned elastic portion is partially provided in the aforementioned pressing portion.

According to the paper sheet processing device of the above seventh aspect, since the elastic portion is partially provided in the pressing portion, the inclination of the pressing portion can be adjusted.

Advantageous Effects of the Invention

According to the present invention, it is possible to provide a paper sheet processing device capable of suppressing the occurrence of jamming of paper sheets while suppressing the increase in cost.

EMBODIMENTS FOR CARRYING OUT THE INVENTION

A paper sheet processing device according to an embodiment of the present invention will be described below with reference to the drawings. A paper sheet processing device 10 according to the present embodiment processes bills as paper sheets. Needless to say, the paper sheet processing device 10 may be used to process paper sheets other than bills. The paper sheet processing device 10 is a bill depositing and dispensing device capable of a deposit processing for internally storing a bill input from the outside and a dispensing processing for dispensing an internally stored bill so as to be removable to the outside. It should be noted that in the following description, the term "front" refers to the operator side, "rear" refers to the opposite side to the operator, "left" refers to the left as viewed from the operator, and "right" refers to the right as viewed from the operator.

Figure 1:
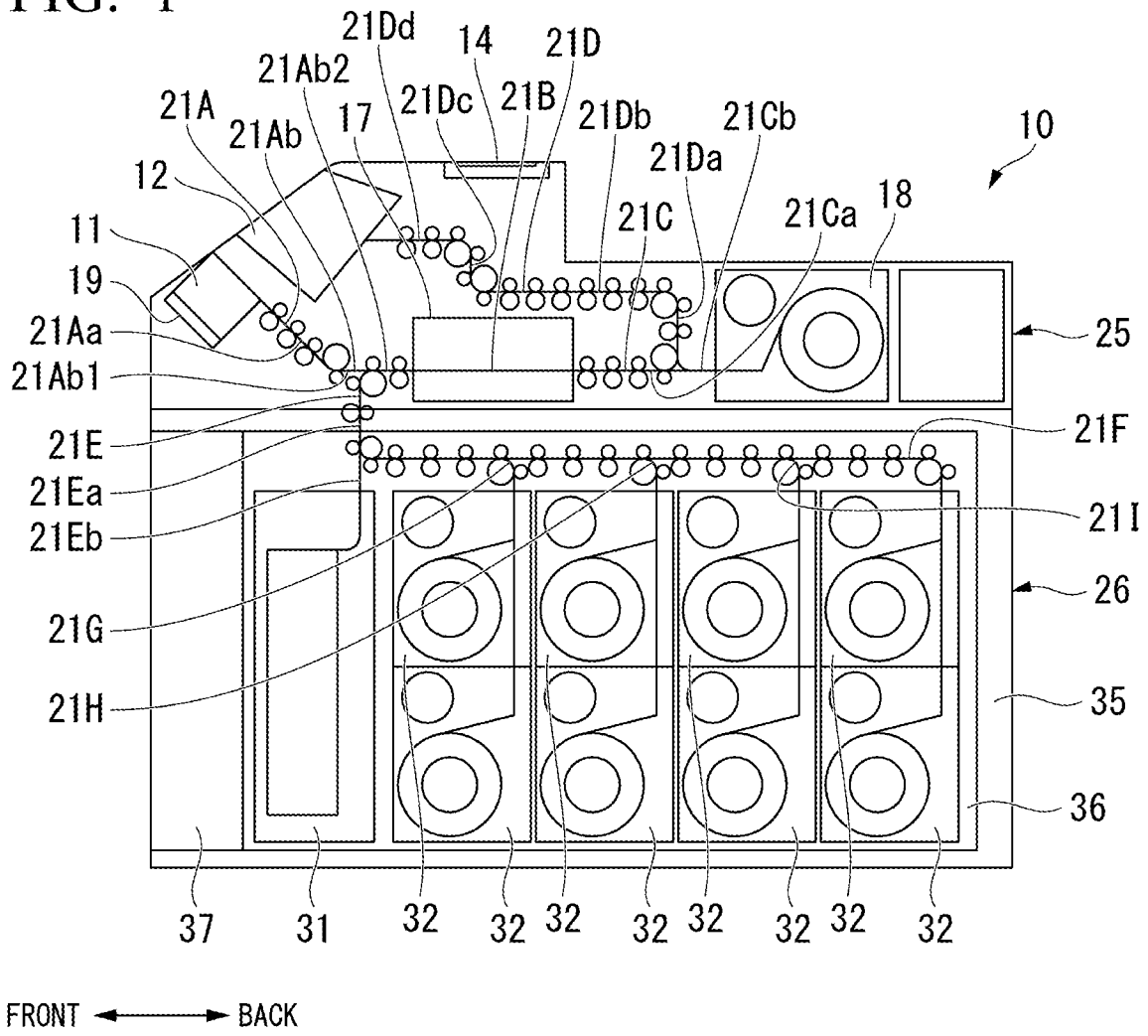
FIG. 1 is a side view schematically showing a paper sheet processing device according to an embodiment of the present invention.

As shown in FIG. 1, an input unit 11 into which bills for deposit are input from the outside is provided at an upper portion on the front surface side of the paper sheet processing device 10. A payout unit 12 is provided above and behind the input unit 11 of the paper sheet processing device 10. The payout unit 12 feeds out unacceptable rejected bills among the bills for deposit from the inside, and also feeds out bills for dispensing from the inside so that these can be taken out to the outside. The input unit 11 and the payout unit 12 are provided side by side in the vertical direction, and are also provided side by side in the front-rear direction. A touch panel type operation display unit 14 for receiving an operation input of an operator and performing display to the operator is provided behind the payout unit 12 on the upper surface of the paper sheet processing device 10.

Behind the input unit 11, an identification unit 17 for identifying bills is provided at a position substantially at the same height as that of the input unit 11. Behind the identification unit 17, a temporary storage unit 18 for temporarily storing the bills identified by the identification unit 17 is provided at a position substantially at the same height as those of the input unit 11 and the identification unit 17.

More specifically, the positions in the height direction of a lower portion of the input unit 11 and an upper portion of the identification unit 17 are substantially the same, and the position in the height direction of an upper portion of the input unit 11 is higher than that of the lower portion of the identification unit 17. The position in the height direction of the identification unit 17 is substantially the same height as that from an intermediate portion to a lower portion in the height direction of the temporary storage unit 18, and the position in the height direction of an upper portion of the temporary storage unit 18 is higher than the position in the height direction of the identification unit 17. The positions of the upper portion of the temporary storage unit 18 and the lower portion of the payout unit 12 in the height direction are substantially the same.

The input unit 11, the identification unit 17, and the temporary storage unit 18 are sequentially arranged in a direction from the front towards the rear of the paper sheet processing device 10. The input unit 11 and the identification unit 17 are provided at positions separated from each other in the front-rear direction of the paper sheet processing device 10. The identification unit 17 and the temporary storage unit 18 are provided at positions separated from each other in the front-rear direction of the paper sheet processing device 10.

The input unit 11 is provided with a mounting plate 19 in a rearward and downward posture. The mounting plate 19 rises in a rearward and obliquely upward direction and descends in a forward and obliquely downward direction in the input unit 11. bills in an accumulated state are placed on the mounting plate 19 in a lowered state from the outside. The bills placed on the mounting plate 19 are in a state of being accumulated in the rearward and obliquely upward direction. The mounting plate 19 rises and lifts the bills in the accumulated state in the rearward and obliquely upward direction, and feeds out the accumulated bills one by one from those at the highest accumulation position into the paper sheet processing device 10.

A deposit transfer path 21A for transferring bills fed out from the input unit 11 is connected to a rear end portion of the input unit 11. The deposit transfer path 21A has an inclined sending path portion 21Aa extending rearward and obliquely downward from the input unit 11, and a horizontal sending path portion 21Ab extending horizontally rearward from the rear end of the inclined sending path portion 21Aa. The deposit transfer path 21A is connected to the identification unit 17 at a rear end portion of the horizontal sending path portion 21Ab.

The identification unit 17 has an internal transfer path 21B that is arranged on the same straight line as the horizontal sending path portion 21Ab of the deposit transfer path 21A and extends horizontally rearward from a rear end portion of the horizontal sending path portion 21Ab. The internal transfer path 21B continuously transfers bills rearward from the horizontal sending path portion 21Ab. The identification unit 17 identifies the authenticity, validity, denomination, multi-feeding, skewing, and the like of the bill during the transfer in the internal transfer path 21B.

A linear transfer path 21C extends horizontally rearward from the rear end portion of the internal transfer path 21B of the identification unit 17. The rear end portion of the linear transfer path 21C is connected to the temporary storage unit 18. The linear transfer path 21C continuously transfers the bills rearward from the internal transfer path 21B. The horizontal sending path portion 21Ab, the internal transfer path 21B, and the linear transfer path 21C of the deposit transfer path 21A are linearly aligned on the same straight line, and the identification unit 17 and the temporary storage unit 18 are connected by the straight linear transfer path 21C. For example, a bill input into the input unit 11 is transferred from the input unit 11 towards the identification unit 17 through the deposit transfer path 21A, and is transferred to the temporary storage unit 18 by the linear transfer path 21C after being identified by the identification unit 17. As described above, the identification unit 17 and the temporary storage unit 18 have portions whose positions in the height direction are substantially the same, and the linear transfer path 21C extends in the lateral direction, more specifically, the horizontal direction to connect these units.

The temporary storage unit 18 temporarily stores bills, takes in and stores the bills transferred by the linear transfer path 21C one by one, and feeds out the stored bills one by one to the linear transfer path 21C. The temporary storage unit 18 is of a winding storage type in which bills are wound around a drum together with a tape and stored, and the bills are unwound and fed out from the drum together with the tape.

A dispensing transfer path 21D branches upward from an intermediate position of the linear transfer path 21C. The dispensing transfer path 21D is connected to the payout unit 12. By the branching of the dispensing transfer path 21D, the linear transfer path 21C is divided into a front side sending path portion 21Ca on the front side from the branch position of the dispensing transfer path 21D and a rear side sending path portion 21Cb on the rear side from the branch position of the dispensing transfer path 21D. bills can be moved between the front side sending path portion 21Ca and the rear side sending path portion 21Cb. Between the front side sending path portion 21Ca and the dispensing transfer path 21D, bills can be transferred from the front side sending path portion 21Ca to the dispensing transfer path 21D. Between the rear side sending path portion 21Cb and the dispensing transfer path 21D, bills can be transferred from the rear side sending path portion 21Cb to the dispensing transfer path 21D.

The dispensing transfer path 21D transfers the bills transferred through the linear transfer path 21C to the payout unit 12. The dispensing transfer path 21D has a vertical sending path portion 21Da, a horizontal sending path portion 21Db, a vertical sending path portion 21Dc, and a horizontal sending path portion 21Dd. The vertical sending path portion 21Da extends vertically upward from an intermediate position of the linear transfer path 21C. The horizontal sending path portion 21Db extends horizontally forward from an upper end portion of the vertical sending path portion 21Da. The vertical sending path portion 21Dc extends vertically upward from a front end portion of the horizontal sending path portion 21Db. The horizontal sending path portion 21Dd extends horizontally forward from an upper end portion of the vertical sending path portion 21Dc to be connected to the payout unit 12.

Here, the payout unit 12 accumulates the bills fed out from the horizontal sending path portion 21Dd of the dispensing transfer path 21D obliquely from the front side and the lower side to the rear side and the upper side. The bills accumulated in the payout unit 12 are taken out of the payout unit 12 to the outside. The dispensing transfer path 21D transfers through branched paths, for example, the bills fed out from the temporary storage unit 18 to the linear transfer path 21C upward from the middle of the linear transfer path 21C and ejects them to the payout unit 12.

The input unit 11, the payout unit 12, the operation display unit 14, the identification unit 17 including the internal transfer path 21B, the temporary storage unit 18, the deposit transfer path 21A, the linear transfer path 21C, and the dispensing transfer path 21D are provided in an upper unit 25 that constitutes an upper portion of the paper sheet processing device 10.

A lower unit 26 is present below the upper unit 25 and constitutes an intermediate portion to a lower portion of the paper sheet processing device 10 in the height direction. The lower unit 26 is provided with a front cassette 31 at a front position. Behind the front cassette 31, a total of eight storage boxes 32 are provided in two upper and lower stages and in four front and rear rows. Among the eight storage boxes 32, four of them at the upper stage have the same position in the height direction, and four of them at the lower stage also have the same position in the height direction. The height of the front cassette 31 is equal to the height of two storage boxes 32. That is, the front cassette 31 and the two upper and lower storage boxes 32 occupy an equal length in the height direction.

A vertical transfer path 21E branches downward from an intermediate position of the horizontal sending path portion 21Ab of the deposit transfer path 21A. The vertical transfer path 21E extends vertically downward from the horizontal sending path portion 21Ab and is connected to the front cassette 31. By the branching of the vertical transfer path 21E, the horizontal sending path portion 21Ab of the deposit transfer path 21A is divided into a front side constitution unit 21Ab1 located on the front side from the branch position of the vertical transfer path 21E and a rear side constitution unit 21Ab2 located on the rear side from the branch position of the vertical transfer path 21E. Between the front side constitution unit 21Ab1 and the rear side constitution unit 21Ab2, bills can be transferred from the front side constitution unit 21Ab1 to the rear side constitution unit 21Ab2. Bills can be moved between the vertical transfer path 21E and the rear side constitution unit 21Ab2. The vertical transfer path 21E transfers downward in a branching manner, for example, bills after being fed out from the temporary storage unit 18 to the linear transfer path 21C and allowed to pass through the identification unit 17, from the middle of the deposit transfer path 21A on the opposite side of the linear transfer path 21C of the identification unit 17, and stores them in the front cassette 31.

The front cassette 31 can take in and store bills one by one, and can feed out stored bills one by one. The front cassette 31 is of an accumulation storage type in which bills are received from the upper portion and are accumulated and stored in a horizontal state from bottom to top, and the stored bills are fed out from those at the upper end portion. The front cassette 31 of an accumulation storage type has a considerably higher bill storage efficiency compared with a winding storage type unit such as the temporary storage unit 18 and a storage box 32 described later.

A storage transfer path 21F branches rearward from an intermediate position of the vertical transfer path 21E. The storage transfer path 21F extends horizontally rearward from the vertical transfer path 21E, and then extends downward in the vicinity of the rear end portion of the paper sheet processing device 10, and is connected to the storage box 32 at the upper stage at the rear end. Through this storage box 32, the storage transfer path 21F is also connected to the storage box 32 at the lower stage at the rear end. By the branching of the storage transfer path 21F, the vertical transfer path 21E is divided into an upper side sending path portion 21Ea on the upper side from the branch position of the storage transfer path 21F and a lower side sending path portion 21Eb on the lower side from the branch position of the storage transfer path 21F.

From the intermediate position of the storage transfer path 21F, a plurality of (more specifically, three) branch transfer paths 21G, 21H, and 21I branch downward. The branch transfer paths 21G, 21H, and 21I are connected to the storage boxes 32 at the upper stage in the front three rows, and are connected to the respective storage boxes 32 at the lower stage in the same row via the storage boxes 32 at the upper stage.

All of the eight storage boxes 32 are winding storage types in which bills are wound around a drum together with a tape and stored, and the bills are unwound and fed out from the drum together with the tape, and feed out the bills while counting. The winding storage type storage boxes 32 store the bills in the order by which they are received, and feed them out in the reverse order of the storage order. For this reason, even when bills of a plurality of denominations are randomly mixed and stored in one unit, the denomination of each bill to be stored can be figured out from the identification result of the identification unit 17. Therefore, it is possible to figure out the denomination of each bill to be fed out.

The storage transfer path 21F and the branch transfer paths 21G, 21H, and 21I transfer rearward, in a branching manner, for example, the bills after being fed out from the temporary storage unit 18 to the linear transfer path 21C and allowed to pass through the identification unit 17 from the middle of the vertical transfer path 21E and selectively store them in the eight storage boxes 32. For example, it is possible to set all of the eight storage boxes 32 as single denomination storage boxes in which bills of a single denomination are set for each, and only the set denomination bills are stored. Alternatively, some of the eight storage boxes 32 can be set as single denomination storage boxes in which bills of a single denomination are set for each, and only the bills of the set denomination are stored, while the rest can be set as mixed denomination storage boxes for storing bills of a plurality of denominations in a denomination-mixed manner.

The lower unit 26 is provided with the front cassette 31, the eight storage boxes 32, a lower portion of the upper side sending path portion 21Ea of the vertical transfer path 21E, the lower side sending path portion 21Eb, the storage transfer path 21F, and the branch transfer paths 21G to 21I. An upper portion of the upper side sending path portion 21Ea of the vertical transfer path 21E is provided in the upper unit 25.

The lower unit 26 includes a casing 35 having a rectangular parallelepiped box shape that opens forward, a unit main body 36 that is arranged in the casing 35 and provided with eight storage boxes 32, and a lid 37 that opens and closes a front opening of the casing 35. The front cassette 31 is provided detachably with respect to the unit main body 36.

Next, main operations of the paper sheet processing device 10 according to the present embodiment will be described.

"Deposit Process"

Figure 2A:
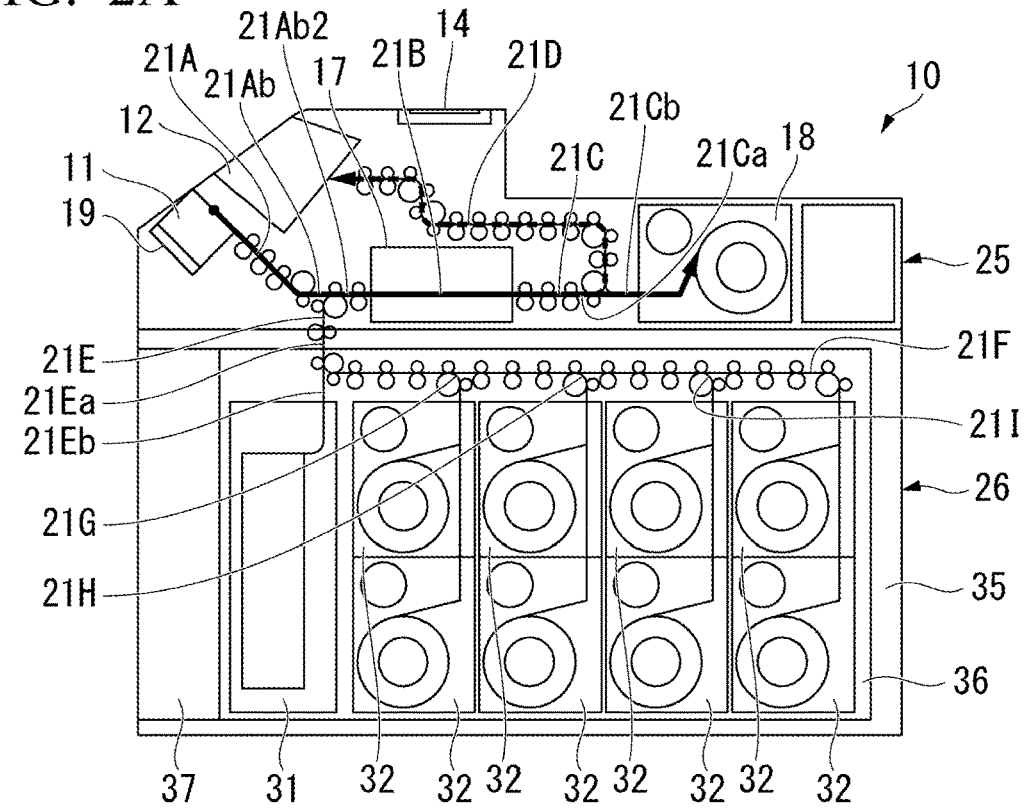
FIG. 2A is a side view schematically showing a deposit process route in the paper sheet processing device according to an embodiment of the present invention.

When bills are input into the input unit 11 from the outside and an operation of starting the deposit process is input to the operation display unit 14, the bills are transferred through a deposit process route indicated by a thick line in FIG. 2A. That is, the input unit 11 separates and feeds out the bills one by one. The bills that have been fed out are transferred by the deposit transfer path 21A, the internal transfer path 21B of the identification unit 17, and the front side sending path portion 21Ca of the linear transfer path 21C. The identification unit 17 identifies the bills during transfer by the internal transfer path 21B. The bills that the identification unit 17 has identified as being acceptable are transferred to the temporary storage unit 18 by the front side sending path portion 21Ca and the rear side sending path portion 21Cb of the linear transfer path 21C, and are temporarily stored by the temporary storage unit 18 (see a thick solid line in FIG. 2A). On the other hand, the bills that the identification unit 17 has identified as being unacceptable are transferred to the payout unit 12 by the front side sending path portion 21Ca and the dispensing transfer path 21D of the linear transfer path 21C (see, from the thick solid line to the thick broken line in FIG. 2A).

Since the input unit 11 separates and feeds out the bills in an accumulated state in the thickness direction, there is a possibility that a transfer failure such as multi-feeding or skewing may occur at the time of feeding out. The bills subjected to such a transfer failure are also identified as being unacceptable by the identification unit 17 and transferred to the payout unit 12. When all the bills input into the input unit 11 have been transferred to either the temporary storage unit 18 or the payout unit 12, the paper sheet processing device 10 displays, on the operation display unit 14, the information on the amount of money such as the number, for each denomination, and the total amount of the bills temporarily stored in the temporary storage unit 18 based on the identification result by the identification unit 17. The bills transferred to the payout unit 12 can be taken out from the outside.

"Storage Process"

Figure 2B:
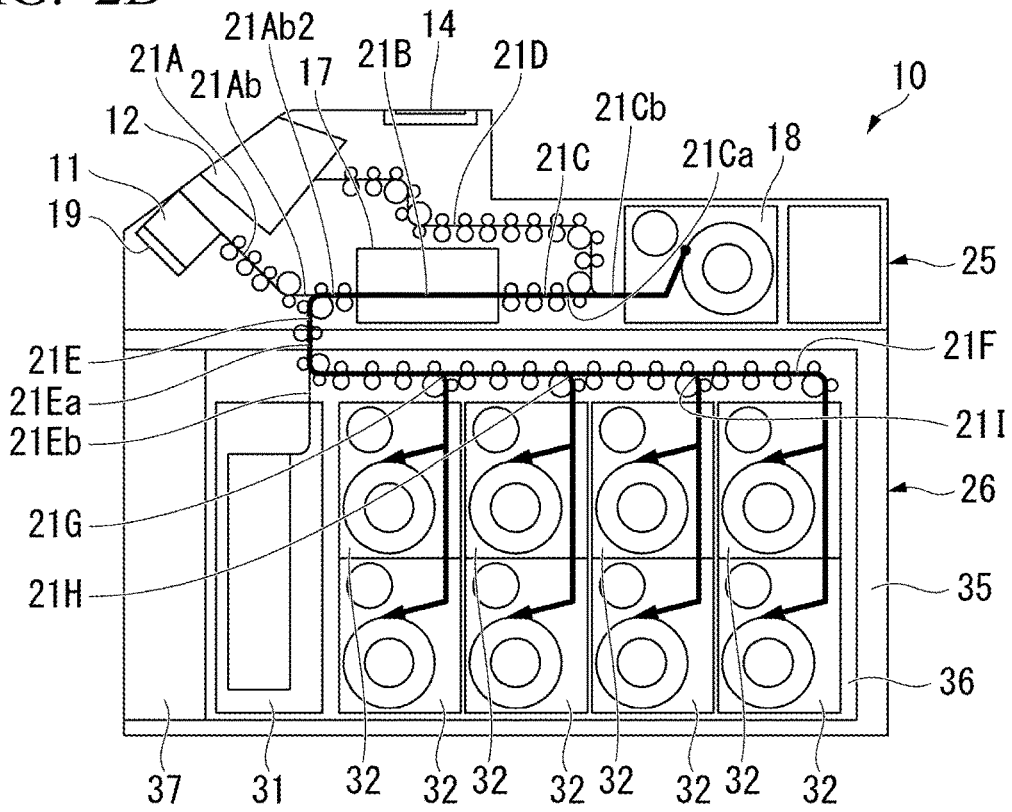
FIG. 2B is a side view schematically showing a storage process route in the paper sheet processing device according to an embodiment of the present invention.

After the deposit process, that is, after the information on the amount of money is displayed on the operation display unit 14, when the operator inputs an approval operation to the operation display unit 14, the paper sheet processing device 10 transfers bills through the storage process route indicated by a thick line in FIG. 2B. That is, the bills temporarily stored in the temporary storage unit 18 are fed out one by one from the temporary storage unit 18 and transferred to any of the eight storage boxes 32 by the linear transfer path 21C, the internal transfer path 21B of the identification unit 17, the rear side constitution unit 21Ab2 of the deposit transfer path 21A, the upper side sending path portion 21Ea of the vertical transfer path 21E and the storage transfer path 21F. The identification unit 17 identifies the bills during transfer by the internal transfer path 21B. Based on the identification result of the identification unit 17, the bills are sorted into any of the eight storage boxes 32 by any of the storage transfer path 21F and the branch transfer paths 21G to 21I. The sorted bills are stored in any of the corresponding storage boxes 32 among the eight storage boxes 32.

Here, since the temporary storage unit 18 is of a winding storage type, there is basically no occurrence of transfer failures such as multi-feeding and skewing at the time of feeding out. Therefore, the bills fed out by the temporary storage unit 18 are not judged to be unstorable by the identification unit 17.

"Return Process"

Figure 3:
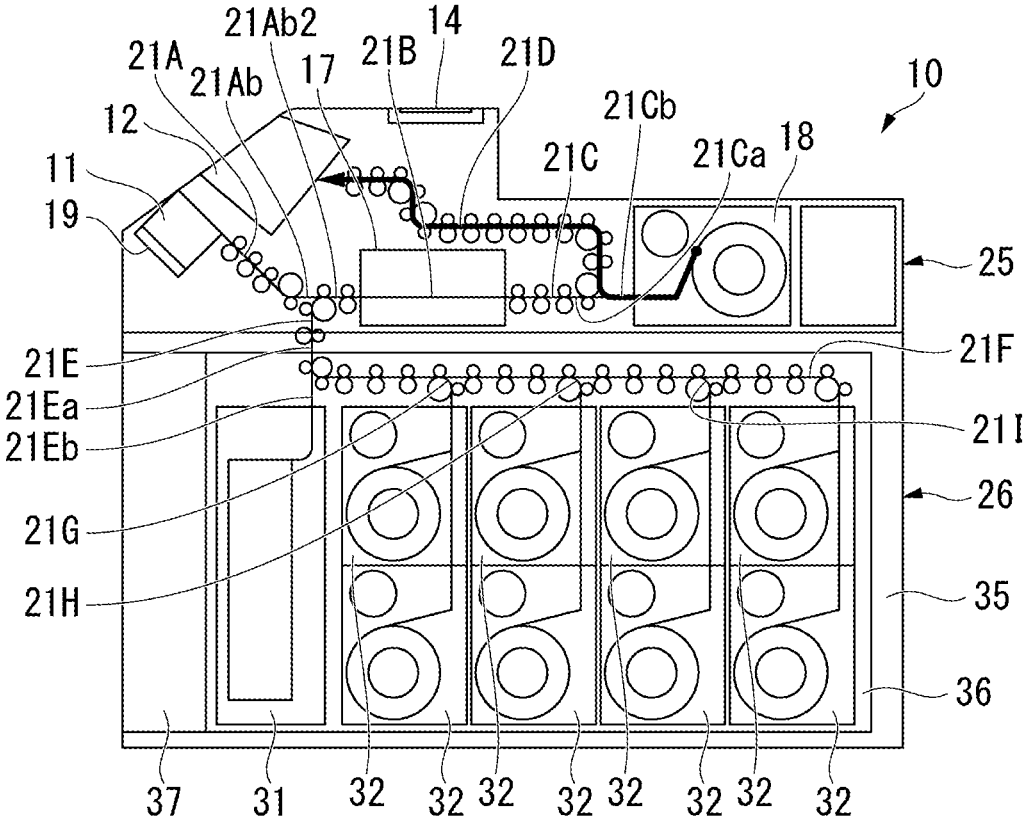
FIG. 3 is a side view schematically showing the paper sheet processing device according to an embodiment of the present invention, in which a return process route is indicated with a thick line.

After the deposit process, that is, after the information on the amount of money is displayed on the operation display unit 14, when the operator inputs a return operation to the operation display unit 14, the paper sheet processing device 10 transfers bills through the return process route indicated by a thick line in FIG. 3. That is, the bills temporarily stored in the temporary storage unit 18 are fed out one by one from the temporary storage unit 18, and transferred to the payout unit 12 by the rear side sending path portion 21Cb and the dispensing transfer path 21D of the linear transfer path 21C. The bills transferred to the payout unit 12 can be taken out (returned) from the outside.

"Dispensing Process"

Figure 4:
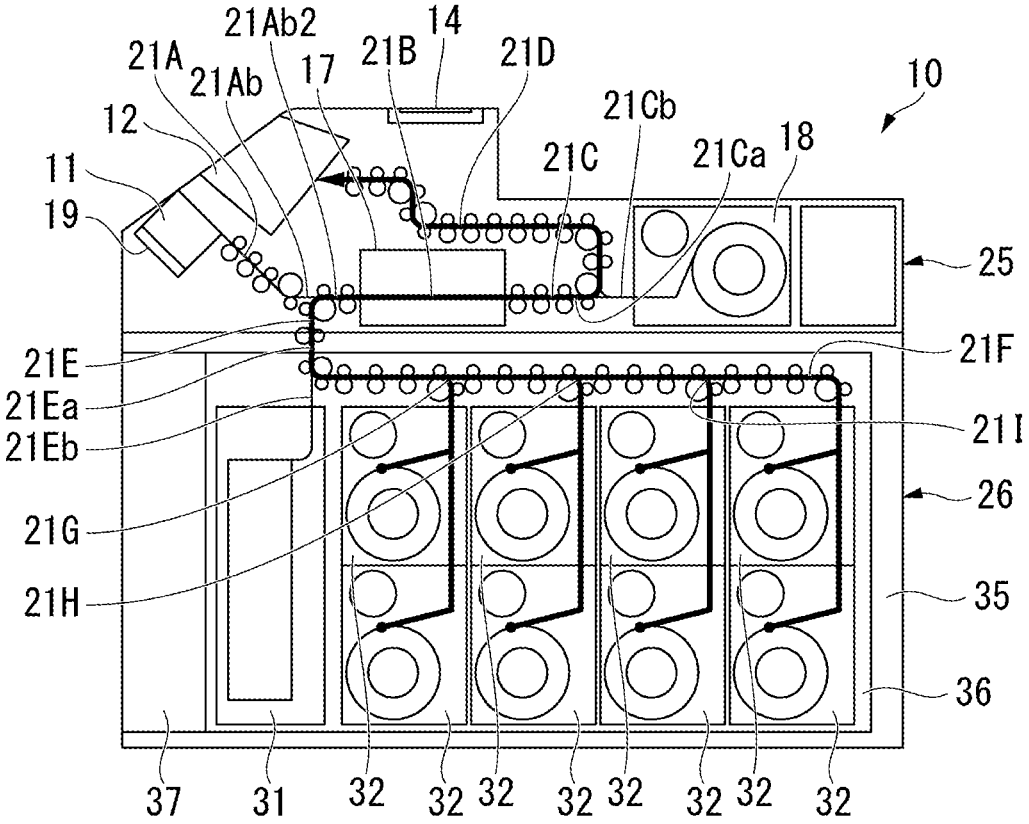
FIG. 4 is a side view schematically showing the paper sheet processing device according to an embodiment of the present invention, in which a dispensing process route is indicated with a thick line.

When a selection operation of the dispensing process is input to the operation display unit 14 together with the information on the amount of money of the bill to be dispensed and the bills are dispensed from the storage box 32 set as the single denomination storage box, the paper sheet processing device 10 transfers the bills through the dispensing process route indicated by the thick line in FIG. 4 from the storage box 32 in which the bills of the denomination to be dispensed are stored. That is, one of the storage boxes 32 feeds out, while counting, the stored bills. The fed out bills are transferred to the payout unit 12 by any of the branch transfer paths 21G to 21I, the storage transfer path 21F, the upper side sending path portion 21Ea of the vertical transfer path 21E, the rear side constitution unit 21Ab2 of the deposit transfer path 21A, the internal transfer path 21B of the identification unit 17, the front side sending path portion 21Ca of the linear transfer path 21C, and the dispensing transfer path 21D. Since all the storage boxes 32 are of a winding storage type, there is basically no occurrence of transfer failures such as multi-feeding and skewing at the time of feeding out, and there is basically no bill to be judged by the identification unit 17 as being impossible to dispense among those that are fed out by the storage box 32. The bills transferred to the payout unit 12 can be taken out from the outside.

Next, the input unit 11 will be described with reference to FIGS. 5 to 14.

Figure 5:
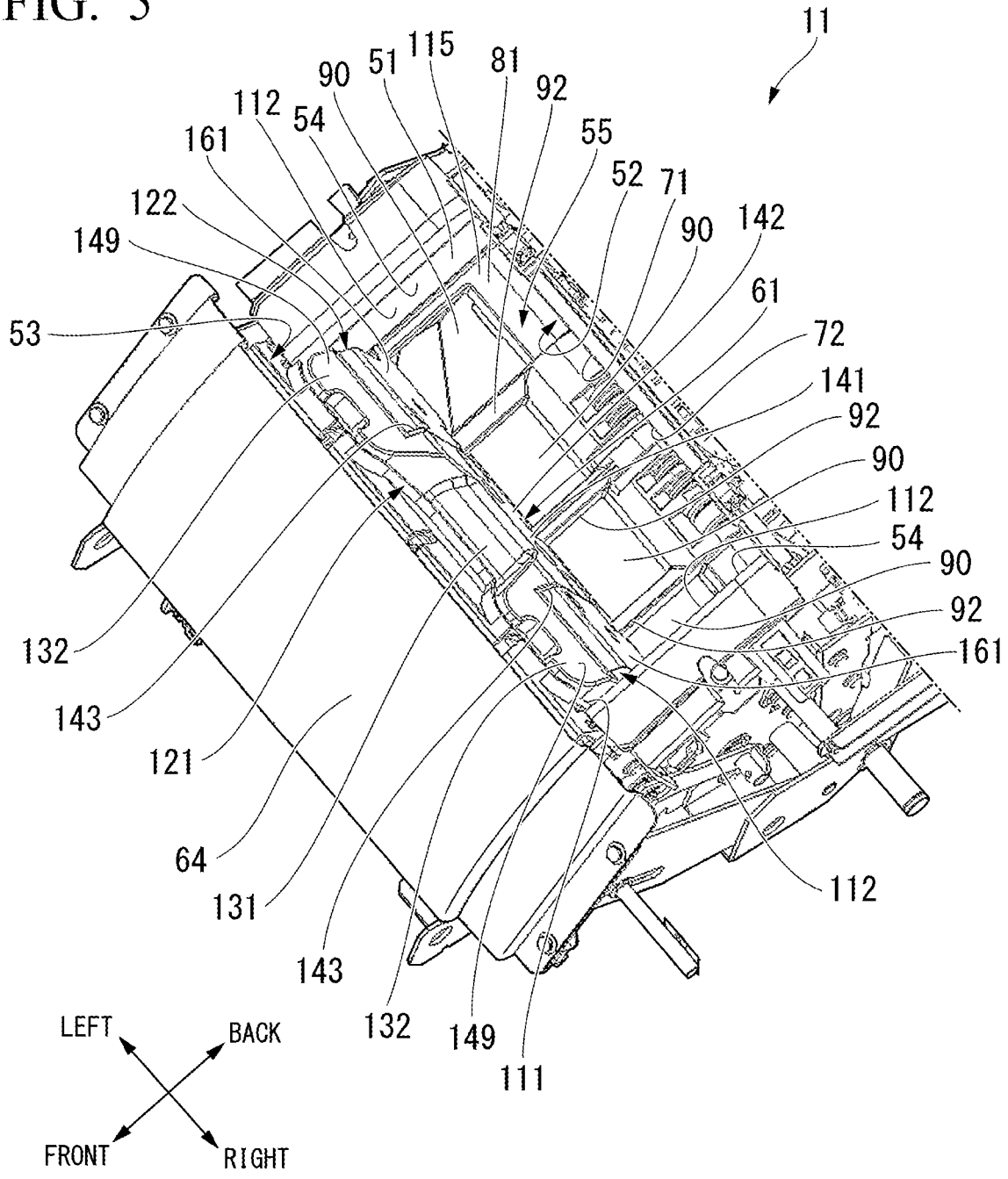
FIG. 5 is a perspective view showing an input unit of the paper sheet processing device according to an embodiment of the present invention.
Figure 6:
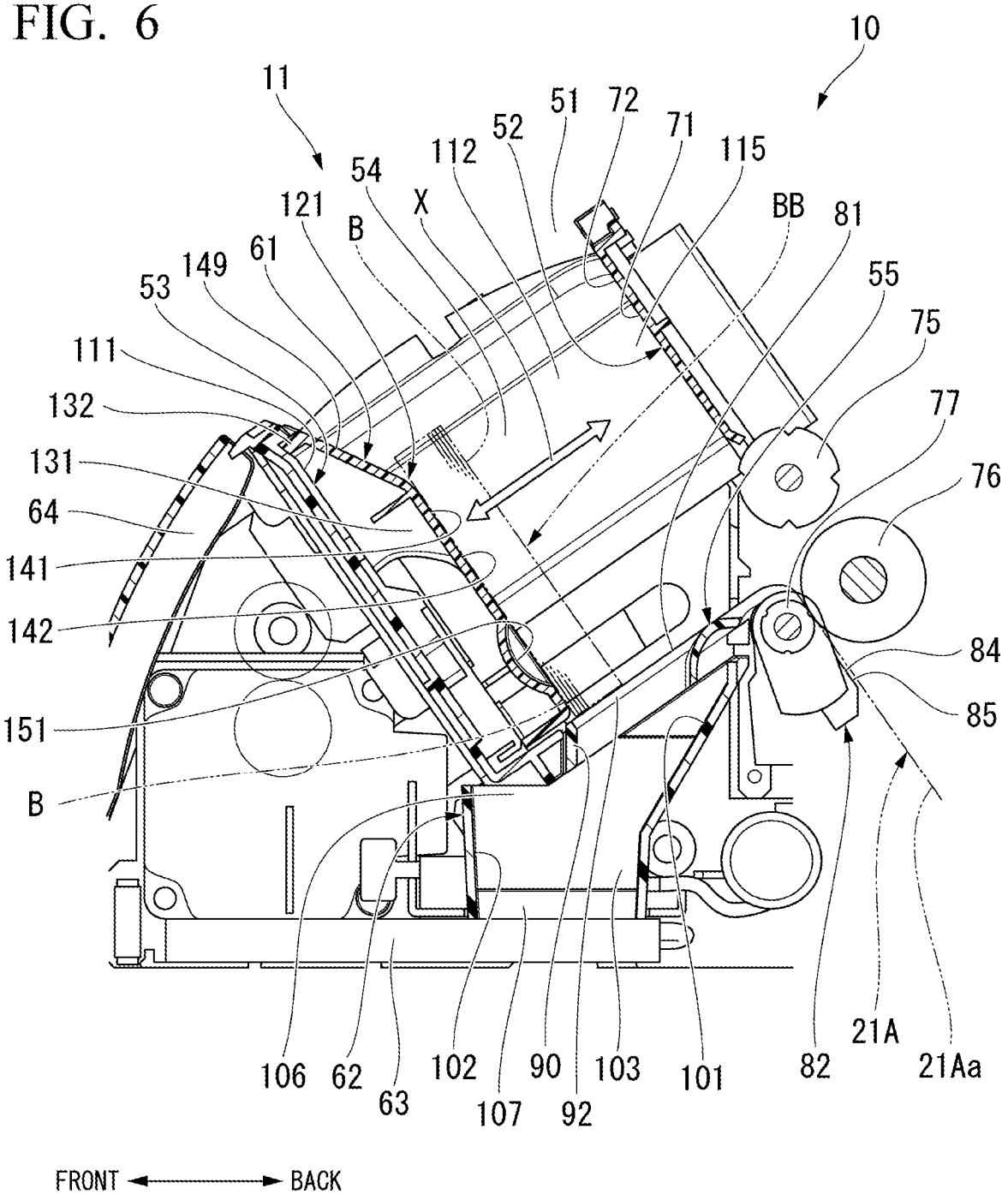
FIG. 6 is a cross-sectional view showing an input unit of the paper sheet processing device according to an embodiment of the present invention.

As shown in FIG. 5, the input unit 11 has a horizontally long, substantially rectangular-shaped opening portion 51 that is long in the left-right direction. As shown in FIG. 6, the opening portion 51 is opened obliquely forward and upward, and the input unit 11 is recessed rearward and downward (in a rearward and obliquely downward direction) from the opening portion 51. The opening portion 51 opens to the outside of the paper sheet processing device 10.

The input unit 11 includes an intake mechanism portion 52 arranged above the opening portion 51, a bottom wall portion 53 arranged below the opening portion 51, and a pair of side wall portions 54 arranged on both left and right sides of the opening portion 51. The intake mechanism portion 52 forms an upper edge of the opening portion 51 with its front edge portion. The bottom wall portion 53 forms a lower edge of the opening portion 51 with its front edge portion. The pair of side wall portions 54 form both left and right edges of the opening portion 51 with their front edge portions. A support portion 55 is provided so as to close a portion surrounded by the intake mechanism portion 52, the bottom wall portion 53, and the pair of side wall portions 54 opposite to the opening portion 51. Further, the input unit 11 includes a bill press 61 provided inside a portion surrounded by the intake mechanism portion 52, the bottom wall portion 53, and the pair of side wall portions 54. In addition, the input unit 11 has a foreign material chute 62 for guiding foreign materials other than bills that have been dropped from the support portion 55 and a receiving tray 63 for accommodating the foreign materials guided and dropped by the foreign material chute 62. Furthermore, the input unit 11 has a shutter 64 that opens and closes the opening portion 51.

The intake mechanism portion 52 is provided with a ceiling portion 72 having a substantially flat-shaped ceiling surface 71 that extends rearward and downward (rearward and obliquely downward) from the upper edge portion of the opening portion 51 and faces the bottom wall portion 53. An ejection roller 75 is provided so as to partially protrude in a forward and downward direction than the ceiling surface 71 from an intermediate portion of the ceiling portion 72 on the opposite side of the opening portion 51. A feeding roller 76 is provided side by side with the ejection roller 75 in a rearward and obliquely downward direction. In a forward and downward direction of the feeding roller 76, a separation roller 77 is provided side by side with the feeding roller 76. The inclined sending path portion 21Aa of the deposit transfer path 21A is arranged in a direction extending rearward of the ceiling surface 71. A plurality of (more specifically, two) ejection rollers 75 are provided separated from each other in the left-right direction. A plurality of feeding rollers 76 are also provided separated from each other in the left-right direction, and a plurality of separation rollers 77 are also provided separated from each other in the left-right direction.

Figure 7:
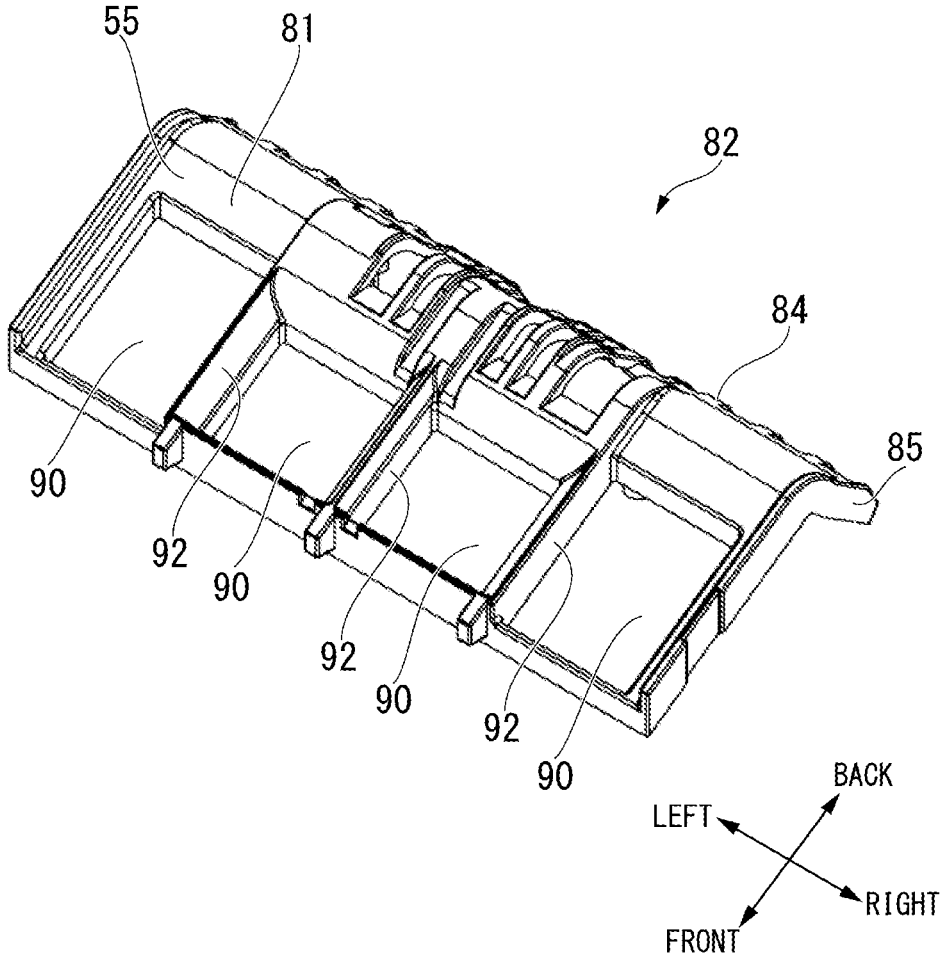
FIG. 7 is a perspective view showing a support member of the paper sheet processing device according to an embodiment of the present invention.
Figure 8:
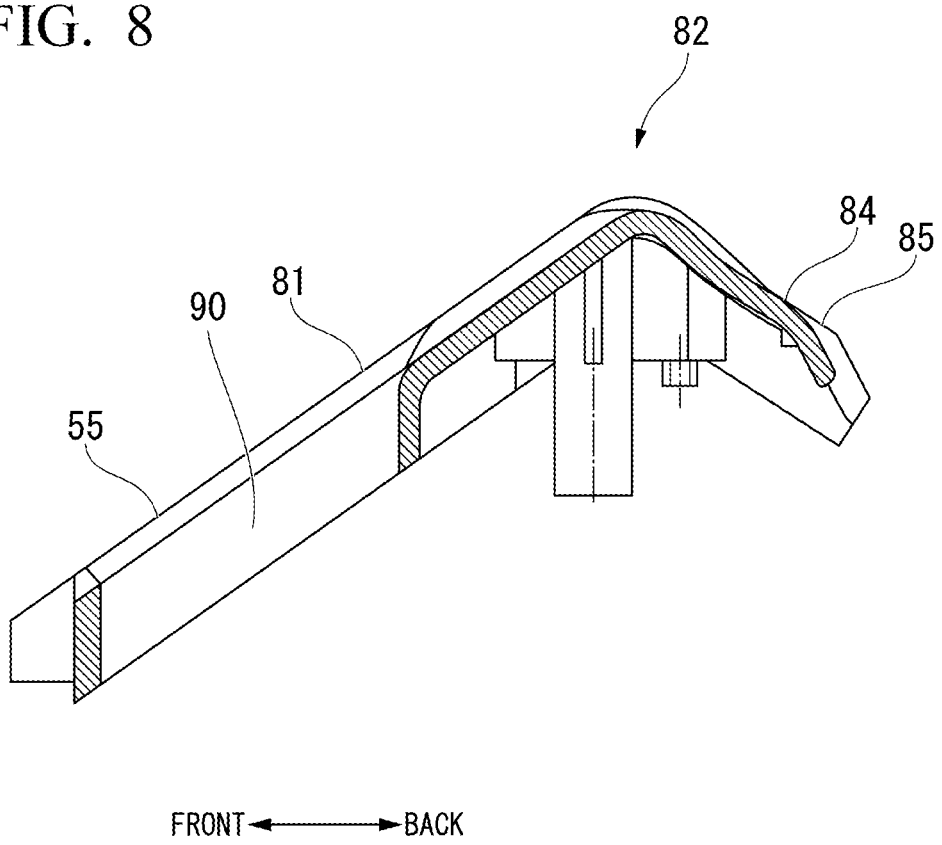
FIG. 8 is a cross-sectional view showing a support member of the paper sheet processing device of an embodiment according to the present invention.

The support portion 55 includes a support member 82 having a substantially planar support surface 81 extending forward and downward (forward and obliquely downward) from the vicinity of the upper end portion of the separation roller 77 and facing the side of the opening portion 51. As shown in FIG. 5, the support surface 81 has a horizontally long, substantially rectangular shape that is long in the left-right direction. As shown in FIG. 7, the support member 82 includes the substantially rectangular support portion 55 having the support surface 81 and a guide portion 85 having a guide surface 84 that extends obliquely from one edge portion of the long side of the support surface 81. In the support portion 55, foreign material dropping holes 90 are formed side by side in the long side extending direction of the support surface 81 at a plurality of (more specifically, four) places. As shown in FIG. 8, the foreign material dropping hole 90 penetrates the support portion 55 in the thickness direction. As shown in FIG. 7, a guide portion 92 extending in the short side extending direction of the support surface 81 is formed between the adjacent foreign material dropping holes 90. The guide portions 92 are formed at a plurality of (more specifically, three) places. As shown in FIG. 6, the guide surface 84 constitutes a portion of the inclined sending path portion 21Aa of the deposit transfer path 21A.

Figure 9:
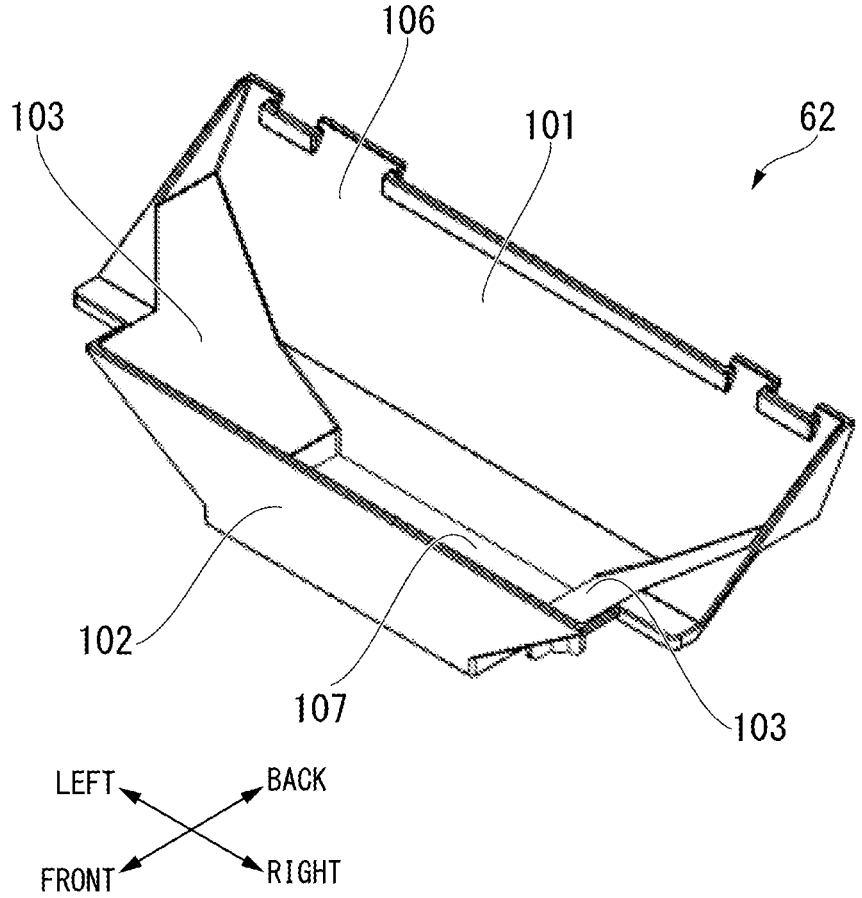
FIG. 9 is a perspective view showing a foreign material chute of the paper sheet processing device according to an embodiment of the present invention.

The foreign material chute 62 is provided below the support portion 55. The receiving tray 63 is provided below the foreign material chute 62. The foreign material chute 62 guides foreign materials falling from the foreign material dropping hole 90. The receiving tray 63 accommodates foreign materials that are guided by and dropped from the foreign material chute 62. As shown in FIG. 9, the foreign material chute 62 includes a guide rear wall 101 extending forward and downward, a guide front wall 102 arranged on the front side of the guide rear wall 101, and a pair of guide side walls 103 connecting the same sides in the left-right direction of these guide rear wall 101 and the guide front wall 102 with each other. The pair of guide side walls 103 are inclined so that the lower portion sides narrow the distance between each other.

In the foreign material chute 62, upper edge portions of the guide rear wall 101, the guide front wall 102, and the pair of guide side walls 103 form an upper opening 106. Lower edge portions of the guide rear wall 101, the guide front wall 102 and the pair of guide side walls 103 form a lower opening 107 in the foreign material chute 62. The lower opening 107 is narrower than the upper opening 106 in the front-rear direction and in the left-right direction. The lower opening 107 extends horizontally and has a horizontally long rectangular shape that is long in the left-right direction. All the foreign material dropping holes 90 shown in FIG. 7 are arranged within an inner range in the horizontal direction of the upper opening 106 of the foreign material chute 62. The lower opening 107 of the foreign material chute 62 is arranged within an inner range in the horizontal direction of the receiving tray 63 shown in FIG. 6.

As shown in FIG. 6, the bottom wall portion 53 has a substantially planar bottom wall surface 111 that is substantially parallel to and faces the ceiling surface 71 of the intake mechanism portion 52. As shown in FIG. 5, the pair of side wall portions 54 respectively have side wall surfaces 112 that are substantially parallel to and face each other. The ceiling surface 71 of the intake mechanism portion 52, the support surface 81 of the support portion 55, the bottom wall surface 111 of the bottom wall portion 53, and the pair of side wall surfaces 112 of the pair of side wall portions 54 form a receiving space 115 that is recessed rearward and downward from the opening portion 51.

The bill press 61 has a horizontally long, substantially rectangular shape that is long in the left-right direction. As shown in FIG. 6, the bill press 61 is substantially parallel to the ceiling surface 71 of the intake mechanism portion 52 and the bottom wall surface 111 of the bottom wall portion 53, and moves back and forth between them as indicated by an arrow X. The bill press 61 moves on the support surface 81 of the support portion 55 along the support surface 81.

In the input unit 11, accumulated bills BB are input into the receiving space 115. More specifically, the accumulated bills BB are input between the intake mechanism portion 52 and the bill press 61 via the opening portion 51. At this time, the accumulated bills BB are placed on the bill press 61, so that one long side of each bill B is made to abut the support surface 81 of the support portion 55, in a state where the long side of each bill B is substantially orthogonal to the pair of side wall portions 54, and the accumulation direction of the bill B is a direction connecting the intake mechanism portion 52 and the bill press 61.

At this time, the bill B at one end portion (the lowest portion) of the accumulated bills BB in the accumulation direction comes into contact with the bill press 61.

When the bill press 61 is moved in the direction of the intake mechanism portion 52 by a bill press drive unit (not shown) in this state, the bill B at the other end portion (the highest portion) of the accumulated bills BB in the accumulation direction on the side of the intake mechanism portion 52 comes into contact with the ejection roller 75. In this manner, the bill press 61 presses the bill B against the ejection roller 75. Next, when the ejection roller 75 and the feeding roller 76 are driven by a feeding drive unit (not shown), the ejection roller 75 ejects the bill B at the end portion of the accumulated bills BB on the intake mechanism portion 52 side. The feeding roller 76 and the separation roller 77 separate the ejected bills B one by one and feed them out to the inclined sending path portion 21Aa of the deposit transfer path 21A.

Figure 10:
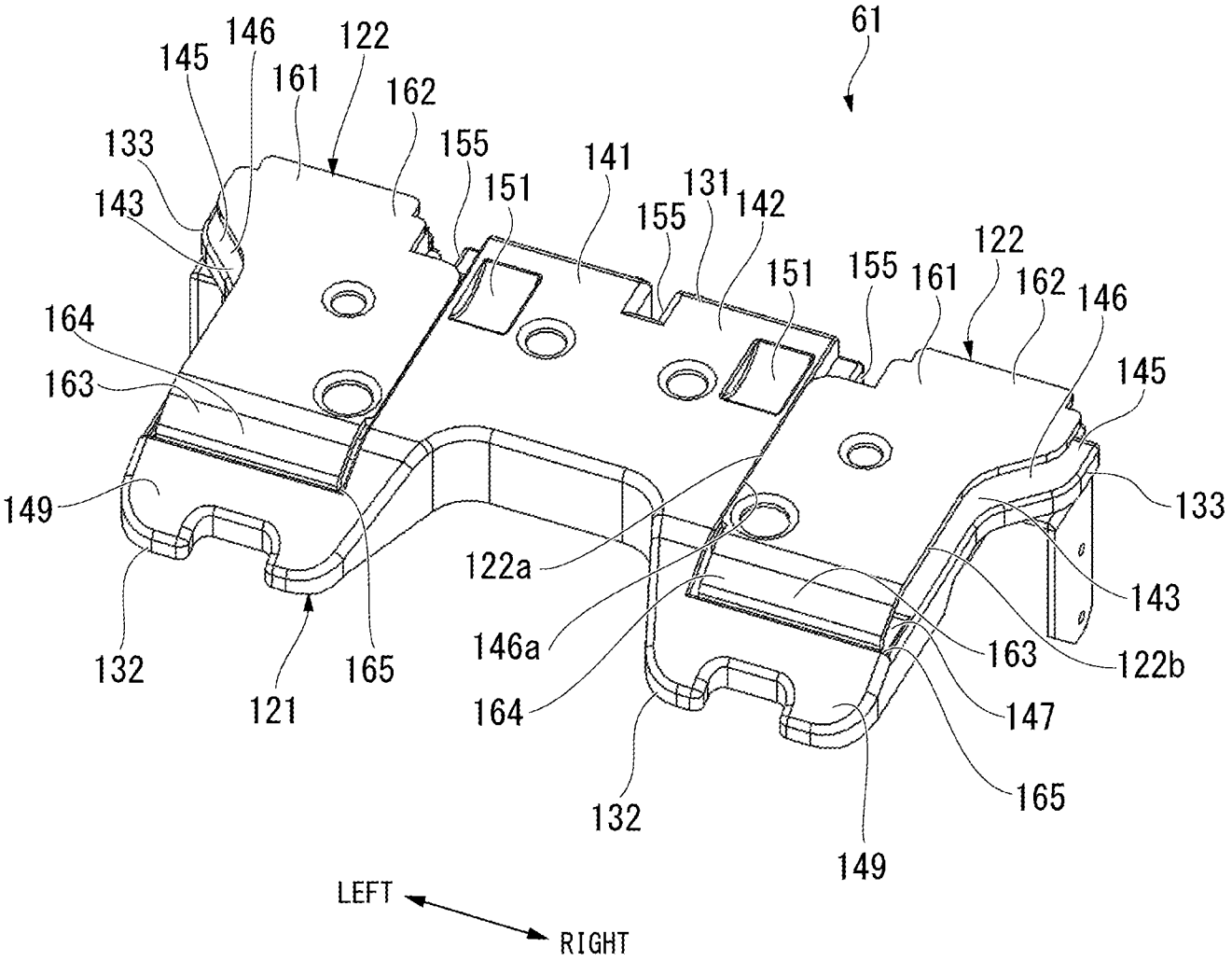
FIG. 10 is a perspective view showing a bill press of the paper sheet processing device of an embodiment according to the present invention.
Figure 11:
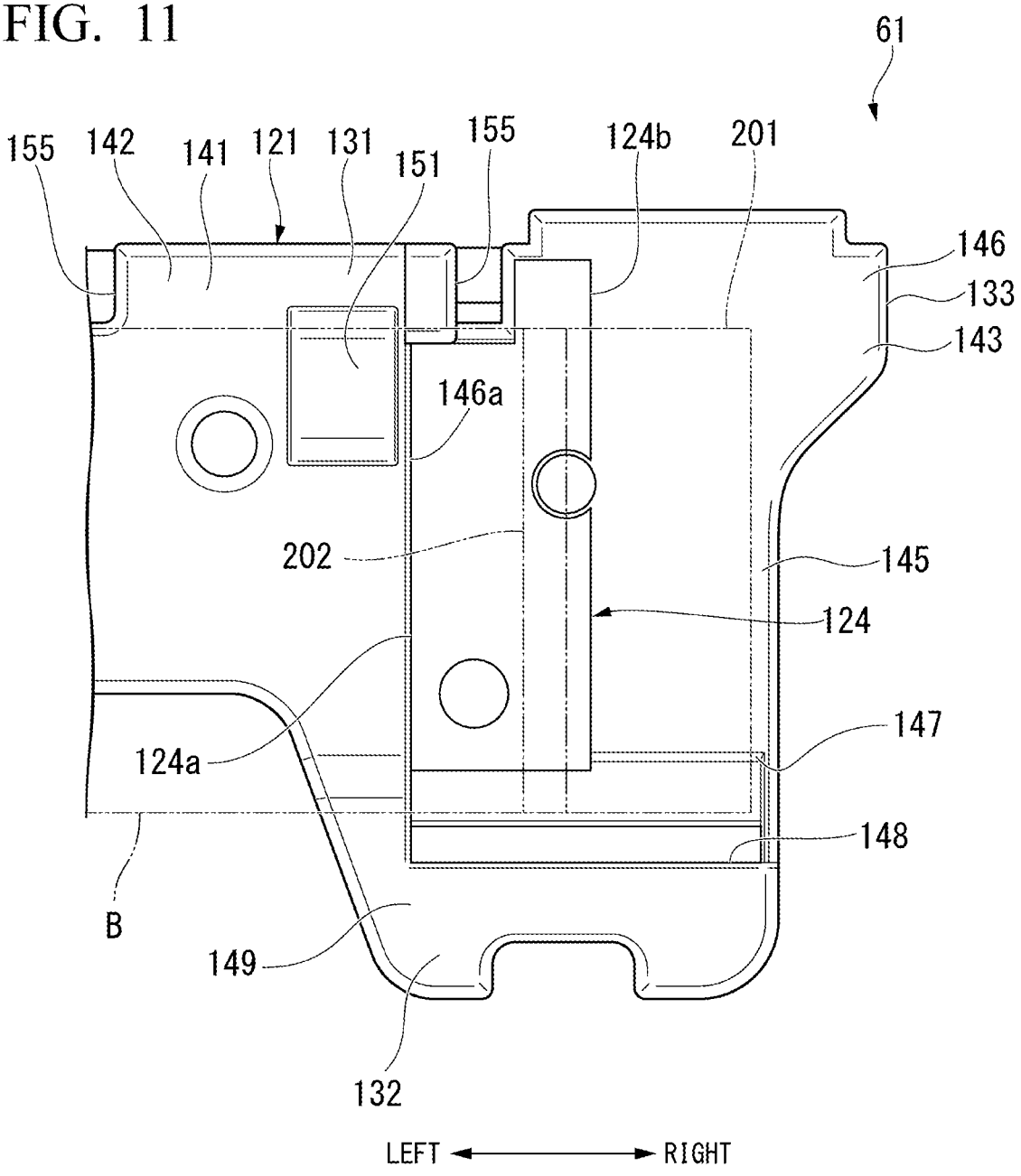
FIG. 11 is a one-side plan view showing a bill press main body and an elastic portion of the paper sheet processing device according to an embodiment of the present invention.
Figure 12:
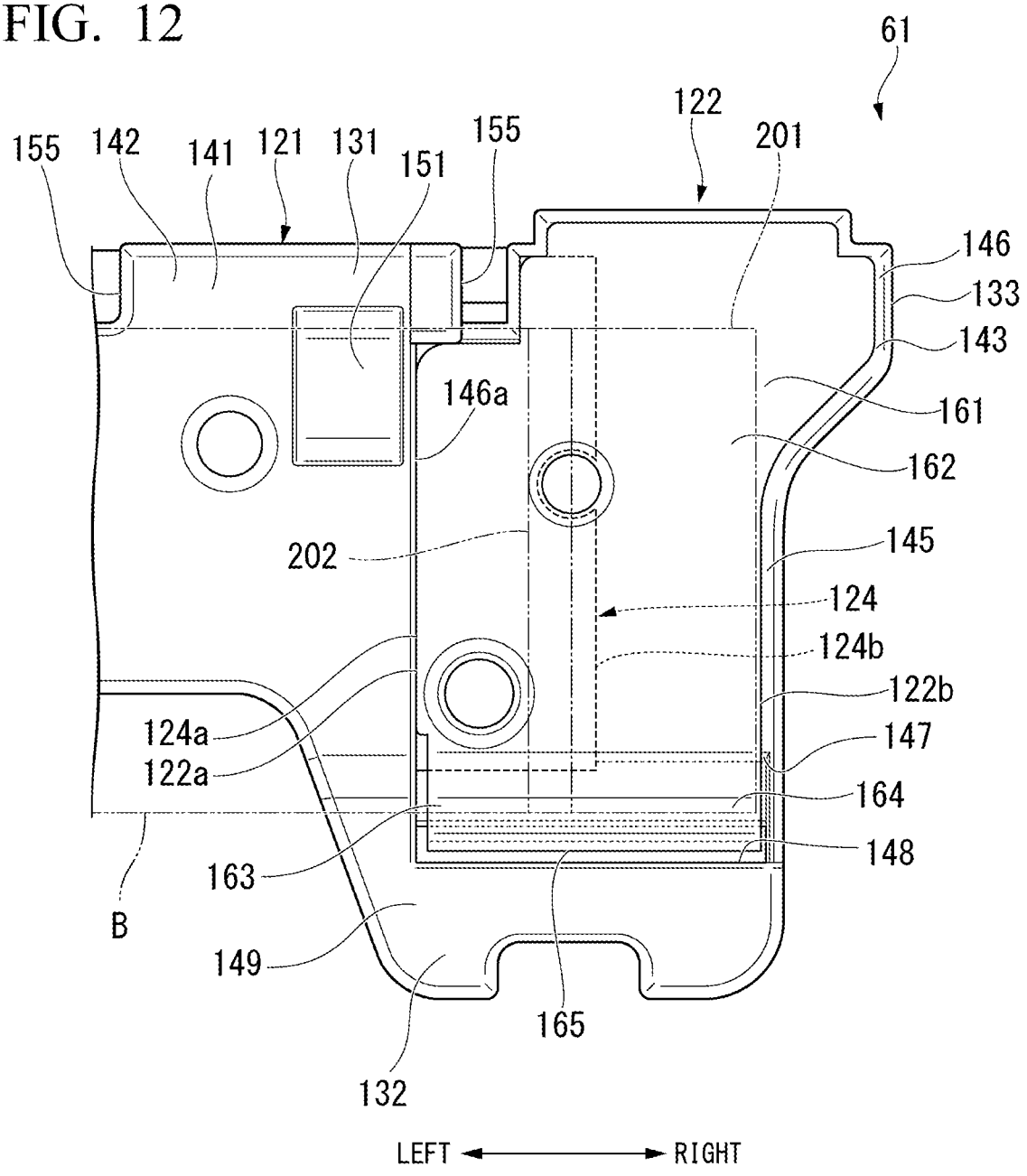
FIG. 12 is a one-side plan view showing a bill press of the paper sheet processing device of an embodiment according to the present invention.

As shown in FIG. 10, the bill press 61 has a horizontally long bill press main body 121 that is long in the left-right direction, that is, the long side extending direction of the placed bill B, and a pair of pressing portions 122 arranged on both sides of the bill press main body 121 in the longitudinal direction, that is, both sides in the long side extending direction of the bill B to be placed. Further, the bill press 61 has an elastic portion 124 provided between the bill press main body 121 and the pressing portion 122 as shown in FIGS. 11 and 12. The elastic portions 124 are provided between the pair of pressing portions 122 and the bill press main body 121, respectively, and support the corresponding pressing portions 122 so as to be able to approach and separate from the bill press main body 121.

In the bill press 61, as shown in FIG. 6, the bill press main body 121 is driven by a bill press drive unit (not shown) and moves back and forth along the support surface 81 between the ceiling surface 71 and the bottom wall surface 111. That is, the bill press main body 121 moves in a direction to approach and separate from the ejection roller 75. The bill press main body 121 moves linearly along the support surface 81 while maintaining a constant angular relationship (substantially parallel) with respect to the ceiling surface 71 and the bottom wall surface 111.

Further, in the bill press 61, the pair of pressing portions 122 shown in FIG. 10 are provided on the side of the ejection roller 75 of the bill press main body 121 shown in FIG. 6. The pair of pressing portions 122 approach and separate from the bill press main body 121. The elastic portion 124 shown in FIGS. 11 and 12 energizes the pressing portion 122 in a direction to separate from the bill press main body 121.

As shown in FIG. 10, the bill press main body 121 has a horizontally long, substantially rectangular-shaped main body portion 131 that is long in the left-right direction. The bill press main body 121 further includes a pair of front protruding portions 132 protruding from one long side of the main body portion 131 along the short side extending direction, and a pair of side protruding portions 133 protruding from both short sides of the main body portion 131 along the long side. The pair of front protruding portions 132 is provided on both sides in the long side extending direction of the main body portion 131. The pair of side protruding portions 133 is provided on the opposite side of the pair of front protruding portions 132 in the short side extending direction of the main body portion 131.

As shown in FIG. 6, the bill press main body 121 has a flat surface portion 141 that is substantially parallel to the ceiling surface 71 and faces the ceiling surface 71 on the ceiling portion 72 side. As shown in FIG. 5, the surface portion 141 is arranged on a convex portion 142 provided at a central portion in the longitudinal direction of the bill press main body 121. The bill press main body 121 has step portions 143 provided on both sides of the convex portion 142 in the longitudinal direction, and recessed in a direction opposite to that of the ceiling portion 72 from the surface portion 141. In other words, the bill press main body 121 has the surface portion 141 on the side of the ejection roller 75 and a pair of step portions 143 that are recessed on the opposite side of the ejection roller 75 from the surface portion 141.

As shown in FIG. 10, the step portion 143 has a step main body portion 146 having a bottom surface 145 parallel to the surface portion 141. As shown in FIG. 11, the step portion 143 includes a concave portion 147 provided at one end portion of the step main body portion 146 and further recessed from the bottom surface 145, and a through hole 148 penetrating through one end portion of a bottom portion of the concave portion 147. The concave portion 147 has a horizontally long rectangular shape that is long in the left-right direction, and the through hole 148 also has a horizontally long rectangular shape that is long in the left-right direction. The concave portion 147 is formed within a range of the front protruding portion 132, and the through hole 148 is formed at an end portion of the concave portion 147 in the protruding direction of the front protruding portion 132 from the main body portion 131.

As shown in FIG. 10, the convex portion 142 having the surface portion 141 is formed on the main body portion 131 and the main body portion 131 side of the pair of front protruding portions 132. The step portions 143 on both sides are formed on the main body portion 131 and the pair of front protruding portions 132 on the main body portion 131 side and on the pair of side protruding portions 133.

On the pair of front protruding portions 132, front inclined surfaces 149 are formed on the ceiling portion 72 side shown in FIG. 5 that are inclined so as to be separated from the ceiling surface 71 as the distance from the support portion 55 increases. These front inclined surfaces 149 are connected to the surface portion 141 on the mutually adjacent sides.

As shown in FIG. 10, in the bill press main body 121, a concave portions 151 that are recessed on the opposite side of the ceiling portion 72 shown in FIG. 6 from the surface portion 141 are provided in a range of the surface portion 141 of the convex portion 142. The concave portions 151 are formed on the surface portion 141 on the side opposite to the pair of front protruding portions 132.

As shown in FIG. 10, one concave portion 151 is close to one step portion 143, and the other concave portion 151 is close to the other step portion 143. The concave portion 151 has a cylindrical bottom surface, and a portion of the ejection roller 75 protruding from the ceiling surface 71 is caused to enter therein, when the bill press main body 121 moves to the side of the ceiling portion 72 shown in FIG. 6.

As shown in FIG. 10, in the bill press main body 121, in an end edge portion of the main body portion 131 on the opposite side of the pair of front protruding portions 132, guide grooves 155 recessed on the side of the pair of front protruding portions 132 from the end edge portion are formed. The guide grooves 155 are provided side by side at a plurality of (more specifically, three) places in the long side extending direction of the main body portion 131. The guide portions 92 of the support member 82 shown in FIG. 7 are arranged in the guide grooves 155, respectively. As a result, the bill press main body 121 is in a state of partially entering the foreign material dropping holes 90.

The elastic portion 124 shown in FIG. 11 is attached to the bottom surface 145 of the step portion 143. The attachment of the elastic portion 124 to the bottom surface 145 is performed, for example, with a double-sided tape. The elastic portion 124 has elasticity, and is composed of a plate-like synthetic resin sponge having a constant thickness (for example, 5 mm). The elastic portion 124 has an end edge portion 124*a* that abuts on the end edge portion 146*a* of the step main body portion 146 on the convex portion 142 side, and an end edge portion 124*b* of the end edge portion 124*a* on the opposite side of the convex portion 142. The end edge portion 124*a* and the end edge portion 124*b* are parallel to each other. In the elastic portion 124, the end edge portion 124*b* is provided at an intermediate portion of the step portion 143 in the left-right direction, and covers a portion of the step portion 143 on the convex portion 142 side. The elastic portion 124 is a plate-like elastic member that extends in a direction orthogonal to the moving direction of the bill press main body 121.

The pair of pressing portions 122 are respectively arranged so as to be attached to the opposite sides of the bottom surfaces 145 of the corresponding elastic portions 124 and accommodated in the step portions 143 as shown in FIG. 12. Therefore, a pair of pressing portions 122 is provided separated from each other in the long side extending direction of the bill B. Further, the convex portion 142 including the surface portion 141 is arranged between the pair of pressing portions 122.

In the pressing portion 122, the edge portion 122*a* on the center side in the longitudinal direction in the bill press main body 121 is in contact with the end edge portion 146*a* of the step main body portion 146 on the convex portion 142 side. The end edge portion 122*b* on the side opposite to the end edge portion 122*a* is arranged outside the end edge portion 124*b* of the elastic portion 124 on the side opposite to the convex portion 142. The elastic portion 124 partially connects a portion of the pressing portion 122 on the surface portion 141 side to the step portion 143. More specifically, the elastic portion 124 connects a substantially half range of the pressing portion 122 on the surface portion 141 side to the step portion 143. In other words, the elastic portion 124 is partially provided in the pressing portion 122, and the elastic portion 124 is provided on substantially the half surface on the back side of the pressing portion 122, more specifically, only on one side close to the center in the long side extending direction of the bill B placed on the bill press 61.

The pressing portion 122 has a plate-like shape, and includes a main plate portion 162 having a flat pressing surface 161, an inclined plate portion 164, and a distal end plate portion 165, as shown in FIG. 10. The inclined plate portion 164 has an inclined surface 163 that extends from one end edge portion of the pressing surface 161 in an inclined manner with respect to the pressing surface 161. The distal end plate portion 165 protrudes perpendicularly to the main plate portion 162 from an end edge portion of the inclined plate portion 164 on the opposite side of the main plate portion 162. The pair of pressing portions 122 are arranged on the ejection roller 75 side of the elastic portion 124 (FIG. 6) in a state where each of the main plate portions 162 extends in a direction orthogonal to the moving direction of the bill press main body 121 as shown in FIG. 11. In the pressing portion 122, the back surface of the main plate portion 162 is attached to the elastic portion 124 using, for example, a double-sided tape.

In the pressing portion 122, the main plate portion 162 is opposed to the step main body portion 146 so as to be able to approach and separate from the step main body portion 146. Further, as shown in FIG. 12, in the pressing portion 122, the inclined plate portion 164 is opposed to the concave portion 147 so as to be able to advance or retreat with respect to the concave portion 147, and the distal end plate portion 165 is opposed to the through hole 148 so as to be able to advance or retreat with respect to the through hole 148. When the main plate portion 162 approaches the bottom surface 145 of the step main body portion 146, the pressing portion 122 causes the inclined plate portion 164 to enter the concave portion 147 or increase the amount of entry, and causes the distal end plate portion 165 to enter the through hole 148 or increase the amount of entry.

The pressing portion 122 is provided in the bill press main body 121 via the elastic portion 124 that can be elastically deformed as a whole so as to be swingable in the bill press main body 121. The pressing portion 122 is located at a separation limit position in a direction in which the main plate portion 162 is separated from the bottom surface 145 by the energizing force of the elastic portion 124. When the pressing portion 122 is pressed, the main plate portion 162 comes close to the bottom surface 145 against the energizing force of the elastic portion 124.

When the pair of pressing portions 122 are located at the separation limit position as shown in FIG. 10 by the energizing force of the elastic portion 124, each of the pressing surfaces 161 becomes flush with the surface portion 141 of the convex portion 142, and each of the inclined surfaces 163 becomes flush with the front inclined surface 149 of the bill press main body 121. Each of the pair of pressing portions 122 individually approaches the bottom surface 145 of the step portion 143 while elastically deforming the elastic portion 124 from a state of being located at the separation limit position. That is, the bill press 61 is configured so that the pair of pressing portions 122 on both outer sides in the long side extending direction of the bill B sinks arbitrarily than the convex portion 142 of the bill press main body 121 that receives the ejection roller 75.

Figure 13:
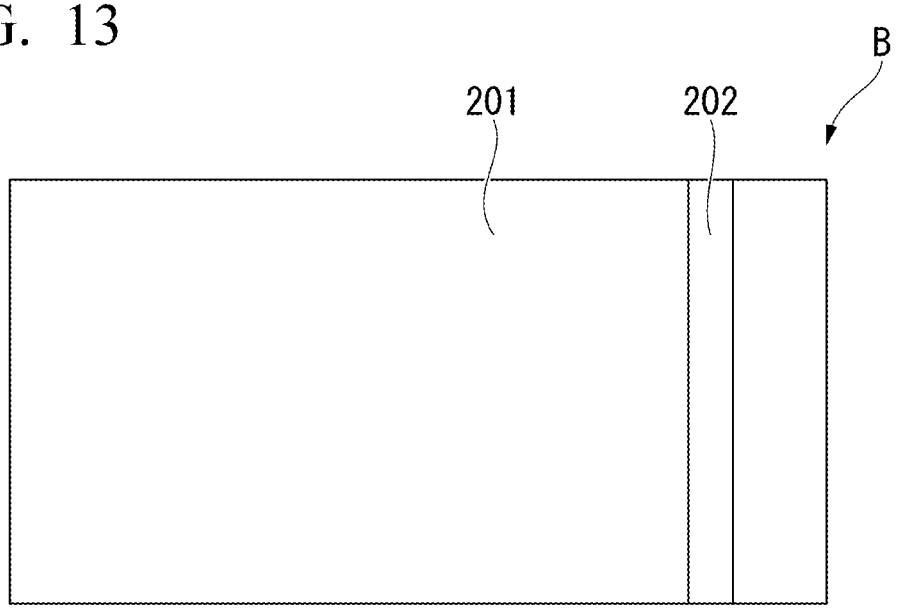
FIG. 13 is a plan view showing a bill to be processed by the paper sheet processing device of one embodiment according to the present invention.
Figure 14:
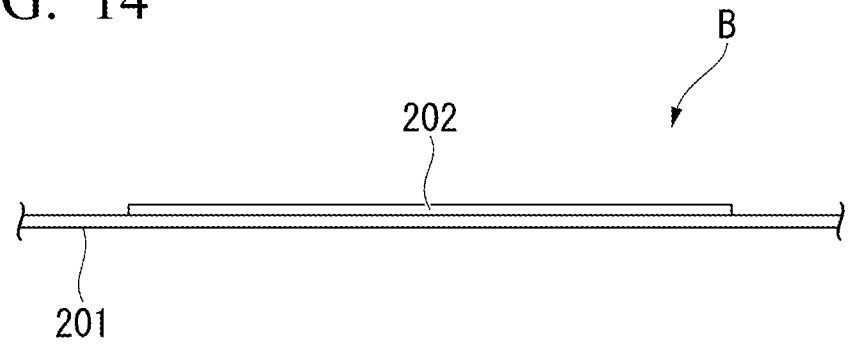
FIG. 14 is a partially enlarged cross-sectional view showing a bill to be processed by the paper sheet processing device of an embodiment according to the present invention.

Here, the bill B is formed in a rectangular shape by printing on paper having a certain thickness. For example, in a bill B such as a ruble bill and a euro bill, as shown in FIG. 13, a security thread 202 which is a metal band-shaped thin hologram is attached to a bill main body 201 in which printing is performed on paper. The security thread 202 is attached to the short side of the bill main body 201 in parallel with the short side. As shown in FIG. 14, the thickness of a portion of the bill B where the security thread 202 is attached to the bill main body 201 is thicker than the thickness of a portion where the security thread 202 is not attached to the bill main body 201.

As shown in FIG. 12, the pair of pressing portions 122 are provided so that the entire width and position of the security thread 202 overlap in the long side extending direction of the bill B placed on the bill press 61. Further the pair of elastic portions 124 are also provided so that the entire width and position of the security thread 202 overlap in the long side extending direction of the bill B placed on the bill press 61. That is, the position of the security thread 202 arranged on one side in the left-right direction of the bill B placed on the bill press 61 overlaps with those of the elastic portion 124 and the pressing portion 122 provided on this one side over the entire width in the long side extending direction of the bill B. The position of the security thread 202 arranged on the other side in the left-right direction of the bill B placed on the bill press 61 overlaps with those of the elastic portion 124 and the pressing portion 122 provided on this other side over the entire width in the long side extending direction of the bill B.

When the bills B having the security thread 202 are accumulated in a state where the security thread 202 is inclined to some extent on the same side in the long side extending direction of the bill B, for example, by aligning the front/back and top/bottom directions, or the like, the accumulation thickness of the accumulated bills BB is different between an accumulated portion on the side with more security threads 202 and an accumulated portion on the side with less security threads 202. In addition, the central portion of the bill B in the long side extending direction is in a state where there is no security thread 202. In particular, when a large number of bills B of the same denomination are accumulated in the same front/back and top/bottom directions, a portion where the thickness of the security thread 202 is increased tends to be higher than other portions.

As described above, in the above input unit 11, it is configured so that the accumulated bills are pushed up from below by a flat-shaped bill press having a constant angle, and pressed against at least a pair of left and right ejection rollers to secure a frictional force, and the bills are ejected by the ejection rollers and sent to transfer paths via a feeding unit having a feeding roller and a separation roller. With such a configuration, when the bills in an accumulated state to which the security thread is attached are taken in one by one, if there is a difference in height in the accumulated bills from left to right, the pressing effect in the bill press is weakened and the pressing force against the ejection roller is reduced at places other than those where a large number of security threads are piled.

In addition, the security thread is sandwiched between the bill press and the ceiling surface when taking in bills, and thus also serves as a resistance at the time of being sent to the transfer paths by the ejection roller. Due to these factors, there is a possibility that the bills to be taken in will be skewed which may cause jamming. For example, when 100 or more overseas bills are aligned in the same direction and stacked, the possibility of skewing increases.

In the case of performing the above-described deposit process or the like, in which the bill B is fed out from the input unit 11 to the deposit transfer path 21A, in the paper sheet processing device 10, a control unit (not shown) rotates the shutter 64 that has been closing the opening portion 51 of the input unit 11 to open the opening portion 51. Further, the accumulated bills BB are placed on the bill press 61 via the opening portion 51 in a state in which, for example, an accumulated portion on the side where the number of security threads 202 is larger is on the right side. Then, based on the detection of the input of the bill B into the input unit 11 by a sensor (not shown), the control unit rotates the shutter 64 to close the opening portion 51, and then a bill press drive unit (not shown) moves the bill press main body 121 of the bill press 61 toward the intake mechanism portion 52 including the ejection roller 75.

Then, the surface portion 141 of the convex portion 142 of the bill press main body 121 causes the center of the accumulated bills BB in the long side extending direction to be pressed against the pair of ejection rollers 75 and the ceiling surface 71 between the pair of ejection rollers 75.

In addition, the right pressing portion 122 moves the right portion of the accumulated bills BB where the number of security threads 202 is large toward the bottom surface 145 side from the surface portion 141, while elastically deforming the elastic portion 124 by the reaction force received from this portion, to be pressed against the ceiling surface 71 by the energizing force of the elastic portion 124 while absorbing the difference in thickness with the center.

Further, the left pressing portion 122 moves the left portion of the accumulated bills BB where the number of security threads 202 is small toward the bottom surface 145 side from the surface portion 141, while elastically deforming the elastic portion 124 by the reaction force received from this portion, to be pressed against the ceiling surface 71 by the energizing force of the elastic portion 124 while absorbing the difference in thickness from the center.

As described above, the pressing portion 122 sinks into the surface portion 141 by an amount corresponding to the thickness of the accumulated bills BB, whereby the bill press 61 presses the accumulated bills BB as a whole while absorbing the difference in height in the accumulated bills BB caused by the security thread 202.

In this state, the control unit drives the ejection roller 75 and the feeding roller 76 by the feeding drive unit. Then, the ejection roller 75 ejects the bill B closest to the ejection roller 75 which comes into contact with the ejection roller 75 among the accumulated bills BB toward the feeding roller 76. The feeding roller 76 and the separation roller 77 feed out the ejected bills B one by one to the deposit transfer path 21A. The ejection roller 75 ejects the bills B at predetermined intervals, whereby the bills B of the accumulated bills BB are fed out one by one to the deposit transfer path 21A.

When the thickness of the accumulated bills BB is gradually reduced by such sequential feeding of the bills B, the control unit moves the bill press main body 121 toward the intake mechanism portion 52 according to the thickness of the accumulated bills BB. The surface portion 141 of the bill press main body 121 maintains a state in which the center of the accumulated bills BB in the long side extending direction is pressed against the pair of ejection rollers 75 and the ceiling surface 71 between the pair of ejection rollers 75.

Further, while elastically deforming the elastic portion 124 by the reaction force received from the right portion of the accumulated bills BB where the number of security threads 202 is large, the right pressing portion 122 positions the right portion of the accumulated bills BB closer to the bottom surface 145 than the surface portion 141. As described above, the right pressing portion 122 presses the right portion of the accumulated bills BB against the ceiling surface 71 by the energizing force of the elastic portion 124 while absorbing the gradually decreasing difference in thickness from the center.

Further, while elastically deforming the elastic portion 124 by the reaction force received from the left portion of the accumulated bills BB where the number of security threads 202 is small, the left pressing portion 122 positions the left portion of the accumulated bills BB closer to the bottom surface 145 than the surface portion 141. As described above, the left pressing portion 122 presses the left portion of the accumulated bills BB against the ceiling surface 71 by the energizing force of the elastic portion 124 while absorbing the gradually decreasing difference in thickness from the center.

As described above, the bill press 61 is configured so that the central portion that receives the pair of ejection rollers 75 is the flat surface portion 141, and the pressing portions 122 on both outer sides of the pair of ejection rollers 75 sink when the side on which the security threads 202 are arranged is pressed, and return to the same height as that of the central portion when the number of bills decreases or completely disappears. Further, it is configured so that the amount of sinking of the pressing portions 122 flexibly changes depending on the amount of bills and the position of the security thread 202. In particular, when a portion where the security threads 202 are stacked comes to the outside of the pair of left and right ejection rollers 75, skewing tends to occur, and it is configured so that the pair of pressing portions 122 on the outside portion from the convex portion 142 that receives the ejection roller 75 which is the outside portion of the bill press 61 sink arbitrarily.

When foreign materials other than bills, such as coins and clips, enter the input unit 11, they are dropped from the foreign material dropping hole 90 formed in the support portion 55 and are removed from the receiving space 115. The foreign materials that have fallen from the foreign material dropping hole 90 are guided by the foreign material chute 62 and accommodated in the receiving tray 63, and taken out and collected to the outside together with the receiving tray 63.

According to the present embodiment described above, when the bill press main body 121 is brought close to the ejection roller 75 at the time of pressing the accumulated bills BB against the ejection roller 75 by the bill press 61, the pressing portion 122 provided on the ejection roller 75 side of the bill press main body 121 comes into contact with the accumulated bills BB and presses the accumulated bills BB toward the ejection roller 75 side. At this time, even if there is a partial difference in thickness in the accumulated bills BB, the elastic portion 124 deforms accordingly to absorb the partial difference in thickness. Accordingly, the pressing portion 122 satisfactorily abuts against the accumulated bills BB and satisfactorily presses the accumulated bills BB. This makes it possible to suppress the occurrence of the skewing of the bill B, and to suppress the occurrence of jamming. Therefore, the bill B can be stably taken inside.

Moreover, since it is configured so that the pressing portion 122 is movably provided in the moving bill press main body 121 and the pressing portion 122 is energized by the elastic portion 124, the structure can be simplified and the increase in cost can be suppressed.

Further, the accumulated bills BB are pressed toward the ejection roller 75 by the surface portion 141 provided on the ejection roller 75 side of the bill press main body 121 and the pressing portion 122 provided on the step portion 143 recessed from the surface portion 141 of the bill press main body 121. Therefore, for example, it is possible to suppress a partial difference in pressing force by pressing a thick portion of the accumulated bills BB with the pressing portion 122 and pressing a thin portion with the surface portion 141 of the bill press main body 121. As a result, it is possible to further suppress the occurrence of jamming.

Further, since the pressing surface 161 becomes flush with the surface portion 141 by the energizing force of the elastic portion 124 in a state in which the pressing portion 122 does not press the accumulated bills BB toward the ejection roller 75 side, it is possible to suppress a partial difference in the pressing force even when there is little partial difference in thickness in the accumulated bills BB.

Moreover, since the concave portion 151 into which the ejection roller 75 enters is provided within the range of the surface portion 141 of the bill press main body 121 whose position with respect to the ejection roller 75 is stable, the bill B can be smoothly ejected by the concave portion 151 and the ejection roller 75 of the bill press main body 121.

In addition, it is possible to press both sides in the long side extending direction of the bills B by the pair of pressing portions 122 provided by being separated from each other in the long side extending direction of the bills B, and to press an intermediate portion in the longitudinal direction of the bills B by the surface portion 141 of the bill press main body 121 therebetween. Therefore, in the case where a thick portion is likely to be formed in the accumulated bills BB on the end portion side in the long side extending direction of the bills B, it is possible to effectively suppress the occurrence of jamming.

Further, since the elastic portion 124 is a plate-like elastic member that extends in a direction orthogonal to the moving direction of the bill press main body 121, and the pressing portion 122 has a plate shape and is arranged on the ejection roller 75 side of the elastic portion 124 in a state of being extended in a direction orthogonal to the moving direction of the bill press main body 121, the structure becomes simpler with no driving source, and the cost increase can be further suppressed.

In addition, since the elastic portion 124 is partially provided in the pressing portion 122, the inclination of the pressing portion 122 can be adjusted. More specifically, the elastic portion 124 is provided only on substantially the half surface on the back side of the pressing portion 122. In this case, for example, assuming that all the security threads 202 of the accumulated bills BB of the predetermined type are stacked, the pressing portion 122 is inclined when it comes into contact with the position of the security thread 202 and sinks. The inclination of the pressing portion 122 at this time decreases linearly toward the outside of the ejection roller 75 in the long side extending direction of the bill B. In this case, from the position of the security thread 202, the bills B located outside the ejection roller 75 in the long side extending direction of the bills B are not crushed and do not become a resistance. Since the pressing portion 122 is moderately sunk at the position of the security thread 202, and the surface of the bill B on the side opposite to the ejection roller 75 is supported substantially uniformly by sinking of the pressing portion 122 in this manner, the posture of the bills B in an accumulated state does not collapse and maintains a stable state. If an intake operation is started in this state, the bill B can be taken in stably without skewing. It should be noted that the position of the elastic portion 124 provided partially in the pressing portion 122 can be adjusted in accordance with the type of the bill B, and the like.

In addition, the movable amount (sinking amount) of the pressing portion 122 of the bill press 61 changes according to the external force due to the amount of the accumulated bills BB and the position of the security thread 202, and is thus less susceptible to the effects of the position of the security thread 202 and the bill size. Therefore, the bills B can be stably taken in, regardless of the type (denomination) thereof.

Although a case where the elastic portion 124 connects a portion of the pressing portion 122 on the surface portion 141 side with the step portion 143 has been described above as an example, the pressing portion 122 may be connected to the step portion 143 entirely and completely. In this case, for example, assuming that all the security threads 202 of the accumulated bills BB are stacked, the pressing portion 122 is inclined when it comes into contact with the position of the security thread 202 and sinks. The inclination of the pressing portion 122 at this time decreases linearly toward the inside of the ejection roller 75 in the long side extending direction of the bill B. In this case, the pressing portion 122 is lifted from the position of the security thread 202 at a location outside the ejection roller 75 in the long side extending direction of the bill B.

Further, in the above description, a system of setting the bills B in an accumulated state on the bill press 61 serving as the mounting plate of the input unit 11, and taking the bills into the device one by one from those at the uppermost position has been described as an example. However, the invention of the present application is not limited to this system, and can also be implemented in a device of a system in which bills in an accumulated state are taken into the device one by one from those at the lowest position. That is, in this case, the surface portion 141 and the pressing portion 122 are arranged on the bill contact surface side of the bill press as a bill pressing plate that holds the bills in the accumulated state from the upper side toward the lower side.

INDUSTRIAL APPLICABILITY

In the above description, the paper sheet processing device for processing bills as paper sheets has been described as an example, but the present invention is applicable to devices for processing various types of paper sheets other than bills, such as securities and cash vouchers.

REFERENCE SYMBOLS LIST

10: Paper sheet processing device
61: Bill press
75: Ejection roller
121: Bill press main body
122: Pressing portion
124: Elastic portion
141: Surface portion
143: Step portion
151: Concave portion
200: Bill (paper sheet)

The invention claimed is:

1. A paper sheet processing device comprising:
an ejection roller for ejecting a paper sheet; and
a bill press for pressing the paper sheet against the ejection roller,
wherein the bill press comprises:
a bill press main body that moves in a direction to approach and separate from the ejection roller;
a pressing portion that is provided on an ejection roller side of the bill press main body and moves in a direction to approach and separate from the bill press main body; and
an elastic portion for energizing the pressing portion in a direction to separate from the bill press main body, and
wherein the bill press main body includes:
a surface portion located on the ejection roller side; and
a concave portion which is formed on the surface portion, and recessed from the surface portion and into which the ejection roller enters.

2. The paper sheet processing device according to claim 1, wherein:
the bill press main body comprises a step portion recessed on the opposite side of the ejection roller from the surface portion; and
the pressing portion and the elastic portion are arranged in the step portion.

3. The paper sheet processing device according to claim 2, wherein the pressing portion is flush with the surface portion by an energizing force of the elastic portion.

4. The paper sheet processing device according to claim 2, wherein a pair of the pressing portions separated from each other are provided in a direction in which a long side of the paper sheet extends, and the surface portion is arranged between the pair of the pressing portions.

5. The paper sheet processing device according to claim 1, wherein:
the elastic portion is a plate-like elastic member orthogonal to a moving direction of the bill press main body; and
the pressing portion has a plate shape which is orthogonal to the moving direction of the bill press main body and is arranged on the ejection roller side of the elastic portion.

6. The paper sheet processing device according to claim 5, wherein the elastic portion is partially provided in the pressing portion.

* * * * *